US005205757A

United States Patent [19]

Hertelendy

[11] Patent Number: 5,205,757

[45] Date of Patent: Apr. 27, 1993

[54] ELECTRICAL CONNECTOR

[76] Inventor: Chris Hertelendy, 3364 Newburg Rd., Louisville, Ky. 40218

[21] Appl. No.: 844,189

[22] Filed: Mar. 2, 1992

[51] Int. Cl.[5] ..... H01R 4/26; H01R 11/20

[52] U.S. Cl. ..... 439/441; 439/439

[58] Field of Search ..... 102/200, 206, 217; 439/395, 435–441, 620

[56] References Cited

U.S. PATENT DOCUMENTS 4,825,765 5/1989 Ochi et al. ..... 102/217

4,927,381 5/1990 Shang ..... 439/438

4,952,167 8/1990 Hertelendy ..... 439/395

4,973,263 11/1990 Nielsen ..... 439/436

*Primary Examiner*—Eugene F. Desmond

*Attorney, Agent, or Firm*—John R. Benefiel

[57] ABSTRACT

An electrical connector adapted to connect electrical leads leading to an explosive detonator, in which a setting recess is formed in the connector housing to produce a setting action between inserted electrical leads and a C-slip terminal having angled tips which wedge against an inserted lead.

4 Claims, 1 Drawing Sheet

ELECTRICAL CONNECTOR

CROSS REFERENCE TO RELATED APPLICATIONS

This application is a division of Ser. No. 07/678,008 filed on Apr. 1, 1991.

BACKGROUND OF THE INVENTION

This invention concerns electrical connectors of the type utilized in connecting the leads to detonating devices as widely used in seismic explorations, construction, and mining.

In copending application Ser. No. 07/162,177, filed on Feb. 29, 1988 for an "Electrical Connector" now U.S. Pat. No. 4,952,167 issued on Aug. 28, 1990, there is disclosed a particular design for providing a highly reliable, waterproof connector for such applications.

In that design, the lead wires are inserted into holes at either end of the connector and pressed between spring metal clip ends of a C-shaped clip and the inside facing surface of a wall of the connector housing. Upon pulling of each wire back, a groove in the respective end of the C-clip bites through the insulated jacket of the wire and deflects the end back to be set in the wall surface to establish an electrical connection between the wires through the C-clip. This design works very well, but there is a need to more reliably maintain the set condition when pushing forces are exerted on the inserted wires, as there is a tendency to loosen the connection under that condition.

SUMMARY OF THE INVENTION

The present invention comprises an improved electrical connector of the type described in U.S. Pat. No. 4,952,167, in which improvement a contained "set" space is provided adjacent each inwardly inclined end of the C-clip. The lead end enters through an entrance hole, of a respective end cap, at a point adjacent the upper region of the interior of the connector housing, aligned with the upper most edge of the C-clip end with which it is to be mated. After the lead end passes between the C-clip end and the housing cavity inner surface, it is pulled back, causing the insulating jacket of the wire lead to be sliced through, and continued tension pulls the clip end outwardly into the set pace, where the lead and clip ends are then wedged securely. This results in a secure electrical connection between the lead end and clip end resisting both pulling and pushing forces exerted on the set wire lead.

Fittings are fit into either end of the housing which define in part the set space, each plug having an offset opening opposite a respective clip end so as to direct a respective electrical lead to a respective clip end.

The housing is preferably sealed as by sonic welding of the interfit housing parts and filled with a sealing substance to protect the delay circuit as well as the electrical connections from the deleterious effects of moisture and other ambient conditions.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be construed inasmuch as the invention is capable of taking many forms and variations within the scope of the appended claims.

Figure 1:
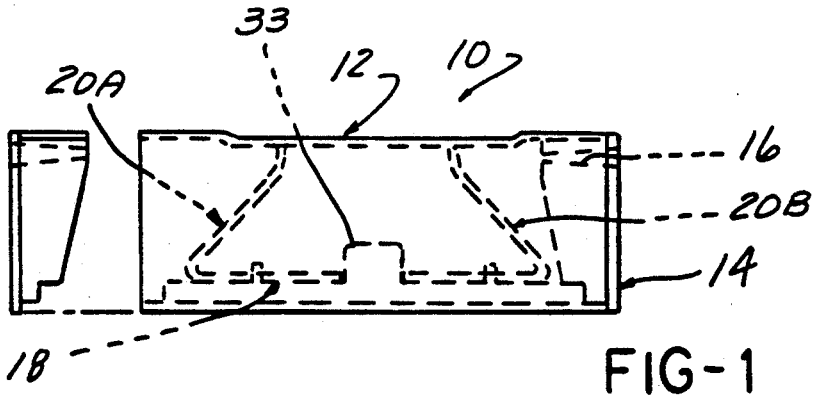
FIG. 1 is a side view of a single lead pair version of the electrical connector according to the present invention.
Figure 2:
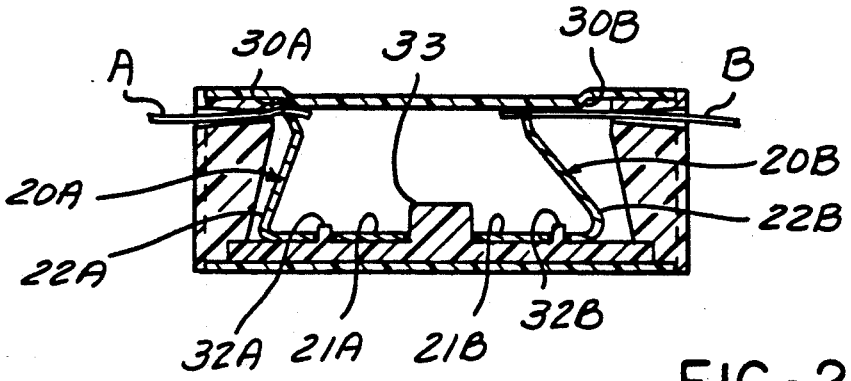
FIG. 2 is a longitudinal sectional enlarged view of the connector shown in FIG. 1 with an electrical lead inserted in either end, one of the leads pulled to the set condition.
Figure 3:
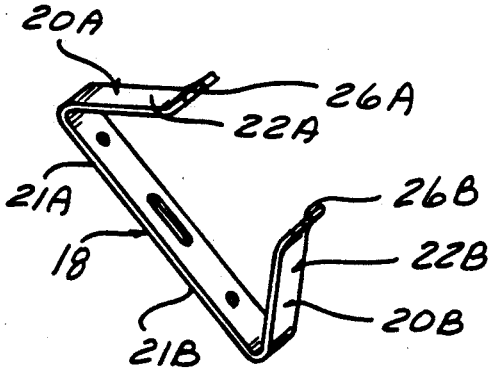
FIG. 3 is a perspective view of the C-clip installed in the housing of the connector of FIGS. 1 and 2.

Referring to FIG. 1, the electrical connector 10 according to the present invention, is adapted to electrically connect a pair of electrical leads securely together, end-to-end, without the use of crimping tools.

The connector 10 includes a housing 12 defining a rectangularly shaped internal cavity 11, the housing preferably molded of a suitable rigid dielectric material, such as a polypropylene plastic.

The housing 12 is elongated and either end receives a plug 14A, 14B configured to close off each end thereof secured and sealed at assembly as by sonic welding or with a suitable adhesive. Each plug 14A, 14B is formed with a pair of conically tapered round bores 16A, 16B, each adapted to receive the end of a respective electrical lead A, B. Each bore 16A, 16B is located offset vertically from the center to be located opposite the upper wall of the housing cavity 14.

The connector housing cavity 11 receives a C-clip assembly 18 sized to be slidably fit into the rectangularly shaped cavity 14 formed therein.

C-clip 18 defines a pair of terminal means for selective connection to electrical leads, comprised of a pair of clip ends 20A, 20B comprising the terminal means, inwardly angled from straight section 21. The ends 20A, 20B and straight section 21 are constructed of a formed flat strip of electrically conductive resilient material, such as spring steel, brass, or beryllium copper. The C-clip ends 20A, 20B are inclined inwardly towards each other to form a ramp surface facing a respective guide hole 16 at either end.

The geometry of the C-clip ends 20A, 20B is different in some respects from that described in the above-reference U.S. patent in that the tips 22A, 22B are bent to decrease the obtuse angle and increase the acute angle otherwise existing with respect to confining surface of the housing cavity 14. This forms a relatively steep angle between the tip and the confining surface of the housing cavity 14. The C-clip ends 20A, 20B are deflected by being assembled into the cavity 11 so that each tip 22A, 22B exerts some pressure against the facing cavity surface.

Thus as a lead 24 or 26 is advanced into the cavity 12 through a bore 16, it encounters the facing surface of the adjacent C-clip end 20A, 20B, deflecting the same to enable advancing of the lead end between the tip 22A and 22B of a respective C-clip 20A, 20B respectively and the surface of the housing cavity 11.

The intended electrical connection is established by a slotted contact recesses 26A, 26B formed in the outer edge of the respective C-clip tip 22A, 22B.

The width of each of the slotted recesses is the same as the thickness of the lead conductor such as to cause the insulating jacket to be sliced through as the lead 28, 30 is pulled back.

Various alternate geometries are possible for the contact recesses 26A, 26B, such as a sharp vee shape geometry, or rounded or serrated central openings inwardly from inclined entry edges guiding the leads into the opening. A strong self gripping action between the tip 22A and 22B and the electrical lead A or B is established, causing slicing through the insulation and seating in the recess 26A or 26B.

Upon continued pulling pressure on the lead A or B, the tip 22A or 22B is pulled outwardly to enter a set recess 28A or 28B defined at either end of the connector by a shoulder 30A, 30B in the upper surface of the cavity 14, and a contoured inner surface of each of the plugs 14A, 14B. The strong self gripping effect enables each end 20A, 20B to be moved outwardly by pulling forces applied to the lead A or B to wedge the same within the inner surfaces of recess 28A, 28B with the respective lead A or B.

This setting action anchors the respective C-clip end 20A, 20B to prevent any loosening after seating of the lead A or B.

The C-clip assembly 18 must be securely anchored to resist shifting in the housing cavity 11 during setting of the leads, and thus molded protrusions 32A, 32B, and central protrusion 33 projecting up from lower housing wall are received in openings in the straight section 21 for this purpose.

In order to insure a waterproof connection, the housing cavity 11 is preferably completely filled with a direction gel or grease such as silicone, a small proportion of which is expelled upon insertion of a wire, insuring continued complete occlusion of that space, and waterproofing protection.

Figure 4:
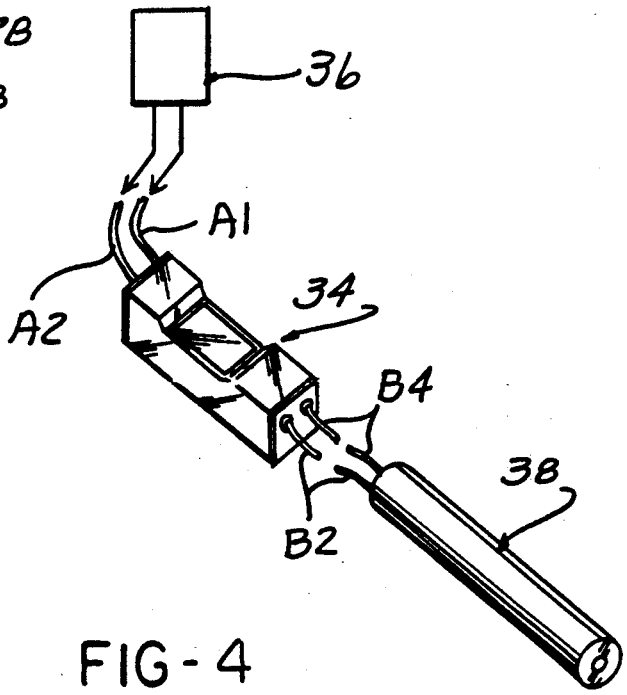
FIG. 4 is a perspective view of a double lead pair version of the connector according to the present invention with connected detonating cap and detonating machine.

FIG. 4 shows that the invention may take the form of a double lead pair connector 34 able to connect each of the two lead pairs A1, A2, B1, B2 required in each detonation circuit between a firing control unit 36 and a detonator 38.

I claim:

1. An electrical connector for establishing a splice connection between electrical leads having an insulating jacket and a conductor core, comprising:

a hollow, elongated connector body of an electrically insulating material having interior walls defining a cavity therein and having an opening at each end; a plug fit into each end having an opening extending into said connector cavity;

a C-clip of a strip of resilient, conductive material disposed in said cavity, said C-clip having a pair of ends, each end extending from an elongated straight portion lying against an inside surface of one wall of said cavity of said connector body and extending lengthwise within said cavity, each of said ends inclined towards the other and away from a respective adjacent opening of said connector body, each end having a tip lying at a point closely adjacent another inside surface of another wall of said cavity of said connector body opposite the inside surface of said first mentioned wall, said tip inclined to form an acute and obtuse angle with said another inside surface, a contact recess formed into a edge of each tip comprised of a slot having closely spaced opposite edges adapted to slice through said insulating jacket and contact said conductor core as an electrical lead is pulled back after insertion into said connector body to be seated within a contact recess, whereby an electrical lead may be inserted at either end to engage and deflect a respective C-clip leg and move past said terminal edge and thereby be gripped against pull-out by the edges of said contact recess sliced into said insulating jacket; and, a set recess defined between each of said plugs, including a step said at either end of another inside surface of said another wall located outward of said each C-clip end tip prior to pulling out of said C-clip tip, each step facing a respective plug thereby creating an increased space outside of said tip and adjacent said respective plug so as to allow a respective tip to move into said increased space as said C-clip end is pulled out, whereby said tip and electrical lead may be wedged into said set recess to secure said connection.

2. The connector according to claim 1 wherein each of said tips is inclined with respect to the remaining C-clip end portion to decrease said angle between said another inside surface and said tip.

3. The connector according to claim 2 wherein each of said plugs has a shaped contour facing respective C-clip end to receive said C-clip end thereagainst upon setting of said electrical lead.

4. The connector according to claim 2 wherein C-clip is fixed in said housing cavity against lengthwise movement therein.

* * * * *